US005585892A

United States Patent [19]

Hayano et al.

[11] Patent Number: 5,585,892

[45] Date of Patent: Dec. 17, 1996

[54] IMAGE FORMING APPARATUS WITH POSITIONING MEMBER OF FRAME ENGAGING SHAFT OF ROLLER OF PHOTOSENSITIVE BELT

[75] Inventors: Tomio Hayano, Hitachi; Shizuo Tsuruta, Kitaibaraki, both of Japan

[73] Assignee: Hitachi, Ltd., Tokyo, Japan

[21] Appl. No.: 357,731

[22] Filed: Dec. 16, 1994

Related U.S. Application Data

[63] Continuation of Ser. No. 164,796, Dec. 10, 1993, abandoned.

[30] Foreign Application Priority Data

Dec. 10, 1992 [JP] Japan ..... 4-330206

[51] Int. Cl.[6] ..... G03G 15/00

[52] U.S. Cl. ..... 355/210; 355/200; 355/211

[58] Field of Search ..... 355/200, 210, 355/211, 212, 213, 260, 271, 272, 273, 277

[56] References Cited

U.S. PATENT DOCUMENTS

| | | | |
|---|---|---|---|
| 4,544,260 | 10/1985 | Kolbe | 355/212 |
| 4,634,264 | 1/1987 | Takahashi | 355/200 |
| 5,291,254 | 3/1994 | Shimada et al. | 355/271 X |

*Primary Examiner*—Sandra L. Brase

*Attorney, Agent, or Firm*—Antonelli, Terry, Stout & Kraus

[57] ABSTRACT

Engaging shafts and are protruded coaxially with a drive roller and driven rollers around which a photosensitive belt is rotatably wrapped inside a photosensitive belt casing, and are positioned in engagement with an engaging groove in a side plate of a frame and with a curved surface formed in a guide rail that guides the photosensitive belt casing. This enables the photosensitive belt to be precisely opposed to an intermediate transfer drum and to developing devices, and to be easily attached to and positioned in the apparatus or detached therefrom.

7 Claims, 5 Drawing Sheets

IMAGE FORMING APPARATUS WITH POSITIONING MEMBER OF FRAME ENGAGING SHAFT OF ROLLER OF PHOTOSENSITIVE BELT

This is a continuation of application Ser. No. 8/164,796 filed Dec. 10, 1993, now abandoned.

BACKGROUND OF THE INVENTION

1. Field of the Invention

The present invention relates to an electro-photographic image forming apparatus in which a toner image is formed by an electro-photographic process on the surface of a photosensitive belt passing around a plurality of rollers, and the toner image is transferred onto the surface of an intermediate transfer drum.

2. Description of the Prior Art

An electro-photographic image forming apparatus such as an electro-photographic copying machine or an electro-photographic printer generally comprises a charging device which uniformly charges the surface of a photosensitive drum with the photosensitive drum as the center, an exposing device which forms an electrostatic latent image by exposing the electrically charged surface of the photosensitive drum in accordance with image data, a developing device which develops the electrostatic latent image and transforms it into a toner image, a transfer device which transfers the toner image onto a recording paper that is fed, and a thermal fixing device which permits the recording paper carrying the toner image to pass in order to fix the toner image on the recording paper.

In order to form a color picture using an image forming apparatus of this type, it has been attempted to complete a color toner image on the surface of an intermediate transfer drum by forming four toner images of different colors (yellow, magenta, cyan and black) on the surface of the photosensitive belt and transferring these four toner images on the surface of the intermediate transfer drum in a superposed manner.

In such an image forming apparatus, the photosensitive belt is an expendable part which requires maintenance or which needs to be replaced after a predetermined time period.

At the time of maintenance work or replacement, the photosensitive belt is detached from the apparatus and then a new one is attached to the apparatus. The photosensitive belt, however, must be fitted in the apparatus in a proper position with respect to the developing devices that act upon the photosensitive belt to develop the electrostatic latent image and with respect to the intermediate transfer drum that transfers the toner image formed through the development, requiring cumbersome adjustment work at the time of maintenance operation and replacement.

A color printer which forms a colored toner image by transferring toner images of the colors formed on the photosensitive belt onto the intermediate transfer dram in a superposed manner, is disclosed in, for example, Japanese Patent Laid-Open. No. 256976/1988 and a mechanism for detachably attaching the photosensitive belt unit is disclosed in, for example, Japanese Patent Laid-Open No. 113277/1985.

In apparatus which effect color printing, however, a plurality of developing devices facing the photosensitive belt are installed, and it is important to precisely position the photosensitive belt so as to face, with precise gaps, the developing rollers of the developing devices.

It is also important to keep constant the width of contact of the photosensitive belt with the intermediate transfer drum since it deeply affects the quality of the printed image.

SUMMARY OF THE INVENTION

The object of the present invention is to provide an image forming apparatus equipped with a detachably mounted photosensitive belt-fitting means by which the precision of the gaps between the photosensitive belt and the developing devices and the width of contact of the photosensitive belt with the intermediate transfer drum can be kept constant.

The present invention provides an image forming apparatus comprising a photosensitive belt unit including an endless photosensitive belt that passes over a plurality of rollers supported by a casing, a drive means which rotates the rollers to rotate the photosensitive belt, a toner image forming means which forms a toner image on the surface of the photosensitive belt that is running, an intermediate transfer drum which rotates in contact with the surface of the photosensitive belt and on which the toner image formed on the surface of said photosensitive belt is transferred, and a frame for assembling them, wherein:

said photosensitive belt unit has a first roller and a second roller that support the photosensitive belt in such a manner as to form a region in contact with the intermediate transfer drum with a predetermined contact width, a third roller which supports the photosensitive belt in such a manner as to form a region where the toner image is formed, an engaging shaft which is protruded coaxially with the first or second roller, and an engaging shaft which is protruded coaxially with said third roller; and said frame has a positioning member by which the photosensitive belt unit is detachably received and which receives the engaging shaft while the photosensitive belt is mounted so as to position the photosensitive belt unit.

Concretely speaking, either the first roller or the second roller is a tension roller, and the engaging shaft is provided coaxially with the other fixed roller. Moreover, the positioning member is formed integrally with a guide rail which is used for attaching and detaching the photosensitive belt unit.

In the photosensitive belt unit, the engaging shaft protruding coaxially with the roller that supports the photosensitive belt in the photosensitive belt unit is provided in engagement with the positioning member of the frame, enabling the photosensitive belt to be highly precisely opposed to the developing devices and the intermediate transfer drum.

DETAILED DESCRIPTION OF THE PREFERRED EMBODIMENTS

An embodiment of the present invention will now be described in conjunction with the drawings.

Figure 2:
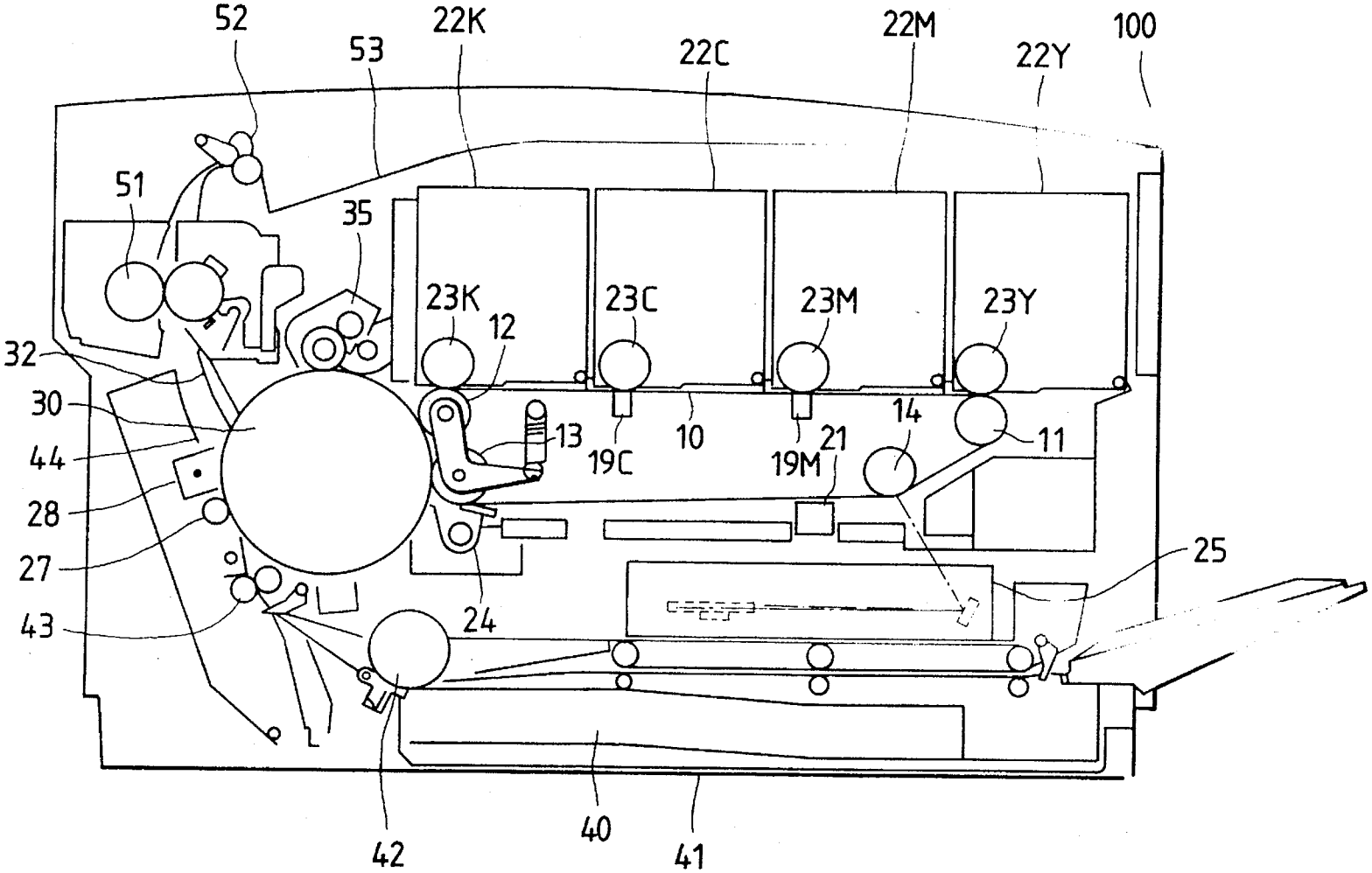
FIG. 2 is a vertically cut side view of a color laser printer of an embodiment according to the present invention.

FIG. 2 illustrates a color laser printer according to the present invention. At the central portion in a frame 100, a photosensitive belt 10 is wrapped around a drive roller 11 and driven rollers 12 to 14 and can run over them. Around the photosensitive belt 10, a charging device 21, an exposing device 25 which turns the laser on and off according to the data from the host to expose the photosensitive belt 10 to the image-bearing light and to form an electrostatic latent image on the photosensitive belt 10, a yellow developing device 22Y, a magenta developing device 22M, a cyan developing device 22C, a black developing device 22K, a belt cleaner 24, and the like. The developing devices 22Y to 22K contain developing rollers 23Y to 23K which are rotatably supported and form magnetic brushes with developing agent.

On the left side of the photosensitive belt 10 is provided an intermediate transfer drum 30 which is in contact with the photosensitive belt 10. On the lower side in the frame 100 are provided a paper cassette 41 which holds papers and a paper-feed roller 42, on the left side are provided a resist roller 43, a transfer roller 27, a charge-removing device 28, a conveyance guide 44, a fixing device 51, and a paper-ejecting roller 52, and on the upper side is provided a ejected paper tray 53. Over the intermediate transfer drum 30 is provided a drum cleaner 35 in contact with or away from the surface of the intermediate transfer drum. A peeling pawl 32 is provided to peel a paper 40 that tends to be attracted by the intermediate transfer drum 30.

Next, described below is the operation of the color laser printer. Here, since the object of the present invention is to improve means for fitting the photosensitive belt 10, the following description does not deal with the formation of electrostatic latent image, developing and transfer in detail.

When the printing of the color image (inclusive of printing of monochromatic image) is started, the laser beam generated from the exposing device 25 is made to go and stop according to the picture data of the colors sent from the host to form electrostatic latent images of the respective colors on the photosensitive belt 10. The developing devices 22Y to 22K develop the corresponding electrostatic latent images to form the toner images. The toner images of the respective colors are transferred onto the intermediate transfer drum 30 in a superposed manner, forming a composite color toner image on the intermediate transfer drum 30.

The paper 40 is fed from inside the paper cassette 41 by the paper-feed roller 42 and is conveyed to the resist roller 43. The resist roller 43 starts rotating in synchronism with the timing of the movement of the color toner image on the intermediate transfer drum 30, and sends the paper 40 to the transfer roller 27.

At the timing at which the paper 40 arrives at the transfer position, the transfer roller 27 moves in a direction where the paper 40 comes into contact with the intermediate transfer drum 30, is simultaneously applied with an electric current, and further presses the paper 40 on the color toner image on the intermediate transfer drum 30, so that the color toner image is transferred onto the paper 40. In this case, the paper 40 is electrically charged by the application of a voltage to the transfer roller 27 and tends to be electrostatically attracted by the intermediate transfer drum 30 in relation to the potential of the intermediate transfer drum 30. The charge-removing device 28 works to neutralize part of the electric charge of the paper 40, so that the electrostatic attracting force decreases. Between the leading end of the paper 40 having a decreased electrostatic attracting force and the intermediate transfer drum 30, a small gap is defined and the peeling pawl 32 enters the gap to reliably peel the paper 40 off. Thereafter, the paper 40 is fixed by the fixing device and is delivered onto the paper-discharge tray 53.

In the above-mentioned electrostatic-photographic color laser printer, the gaps between the photosensitive belt 10 and the opposing developing rollers 23 must be highly precise and, besides, the photosensitive belt 10 should not be waved or lifted up. Therefore, a pressure is given to the roller 12 by a resilient member such as a coil spring in order that the photosensitive belt 10 passes over the plurality of rollers 11 to 14 and suitably tensed. Contrivance is further made for precisely positioning the photosensitive belt 10 inside the frame 100.

Figure 3:
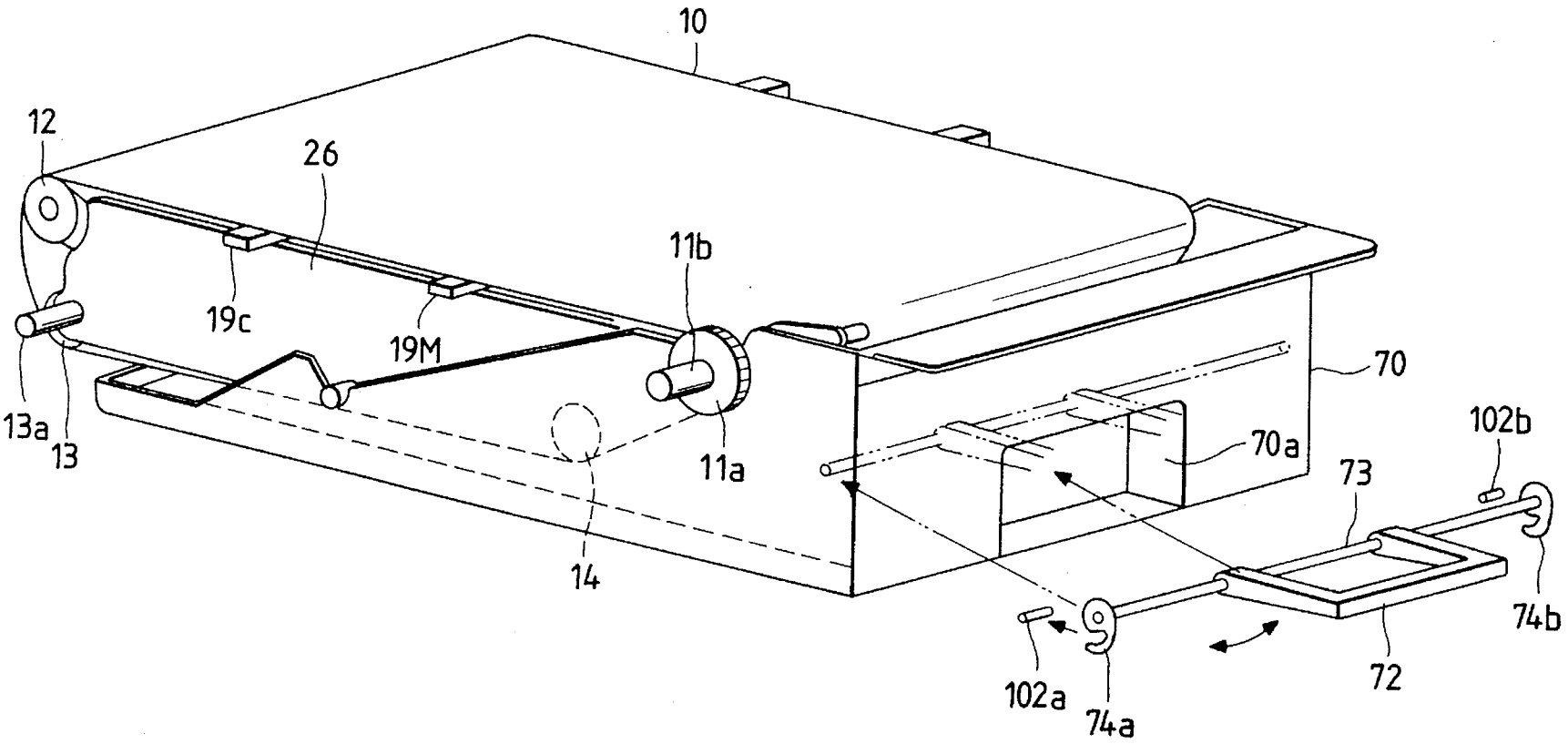
FIG. 3 is a perspective view of the photosensitive belt unit according to the present invention.
Figure 4:
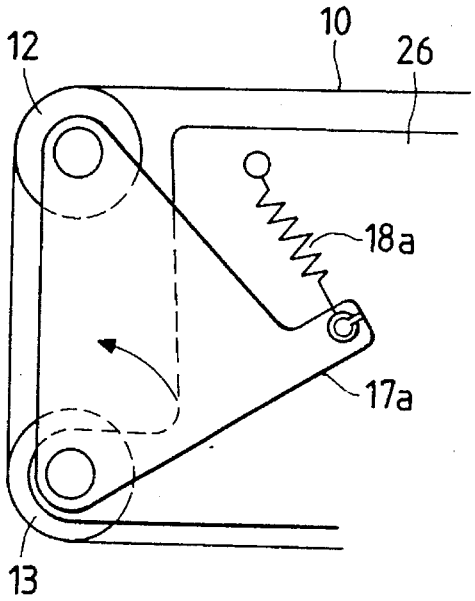
FIG. 4 is a side view showing a first embodiment of the mechanism for imparting tension to the belt in the photosensitive belt unit according to the present invention.
Figure 5:
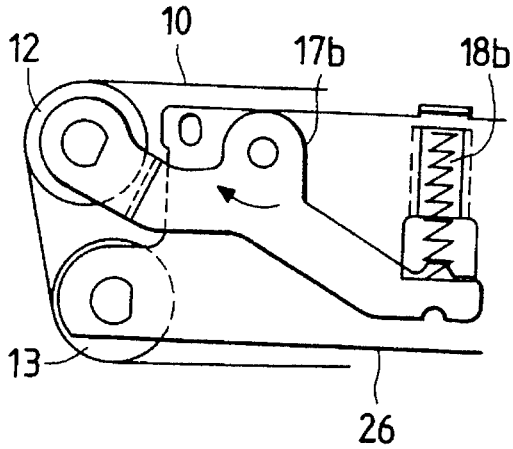
FIG. 5 is a side view showing a second embodiment of the mechanism for imparting tension to the belt in the photosensitive belt unit according to the present invention.
Figure 6:
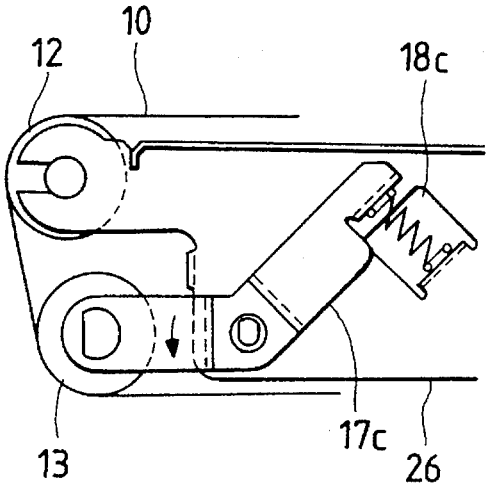
FIG. 6 is a side view showing a third embodiment of the mechanism for imparting tension to the belt in the photosensitive belt unit according to the present invention.
Figure 7:
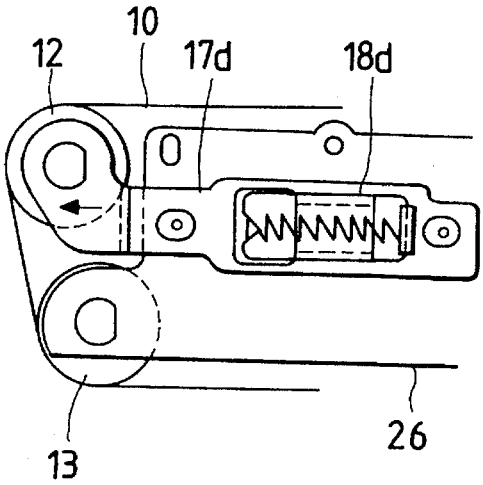
FIG. 7 is a side view showing a fourth embodiment of the mechanism for imparting tension to the belt in the photosensitive belt unit according to the present invention.

Referring to FIG. 3, the photosensitive belt 10 is made to pass nearly in a trapezoidal shape around the drive roller 11, and driven rollers 12, 13, and 14 that are rotatably mounted on a supporting frame 26 in a photosensitive belt casing 70, being combined in one unit. The drive roller 11 is coupled to a drive mechanism via a gear **11*a*, and an engaging shaft 11*b* protrudes coaxially from both ends thereof that for their positioning. The driven rollers 12 and 13 are so arranged that the photosensitive belt 10 is in contact with the intermediate transfer drum 30 with a predetermined contact width. The driven roller 12 is a tension roller that can be displaced and to which a constant force of displacement is imparted by a resilient member or the like. The driven roller 13 is a fixed roller and an engaging shaft 13*a* protrudes coaxially from both ends thereof. The driven roller 14 supports the photosensitive belt 10 in order to precisely define the surface that will be exposed by the exposing device 25. The driven roller 14 can be omitted if the drive roller 11 is utilized to define the surface of exposure. Therein, each of the engaging shafts 11*b* and 13*a*** have bearings (not shown in the figure) on their engaging portions to prevent abrasion.

There is provided a depressed part **70*a* on the front side of side-face of the photosensitive belt casing 70 rotatably to attach a handle 72. Said handle 72 attached to the depressed part 70*a* is fixed to a rotating shaft 73 which rotatably penetrates the side walls of said depressed part 70*a* and the side walls of the photosensitive belt casing 70 itself. Hooks 74*a* and 74*b* are secured to the ends of said rotating shaft 73 which are projected out of the side faces of said photosensitive belt casing 70. Said hooks 74*a* and 74*b* rotate being accompanied with the rotation of said handle 72 and engage with engaging pins 102*a* and 102*b* perpendicularly mounted on the inside faces of side walls 101 to push the photosensitive belt casing 70** toward its mounting direction.

Describes below with reference to FIG. 4 to FIG. 7 are four mechanisms that tense the photosensitive belt 10 by giving a force of displacement to the driven roller 12. In the constitution of an embodiment in FIG. 4, the driven roller 12 is mounted on a tension arm 17*a* that is supported by the supporting frame 26 coaxially with the driven roller 13 to turn, and a constant tension is imparted to the tension arm 17*a* by a pulling spring 18*a*. In the constitution of an embodiment in FIG. 5, the position where the tension arm 17*b* is supported is changed, and a constant tension is imparted by a pushing spring 18*b*. In the constitution of an embodiment in FIG. 6, the driven roller 12 is of fixed type, and the driven roller 13 is supported by the tension arm 17*c* and a constant tension is imparted thereto from a pushing spring 18*c*. In the constitution of an embodiment in FIG. 7, the tension arm 17*d* that supports the driven roller 12 is slidably mounted on the supporting frame 26 and is imparted a constant tension by a pressing spring 18*d*.

Figure 8:
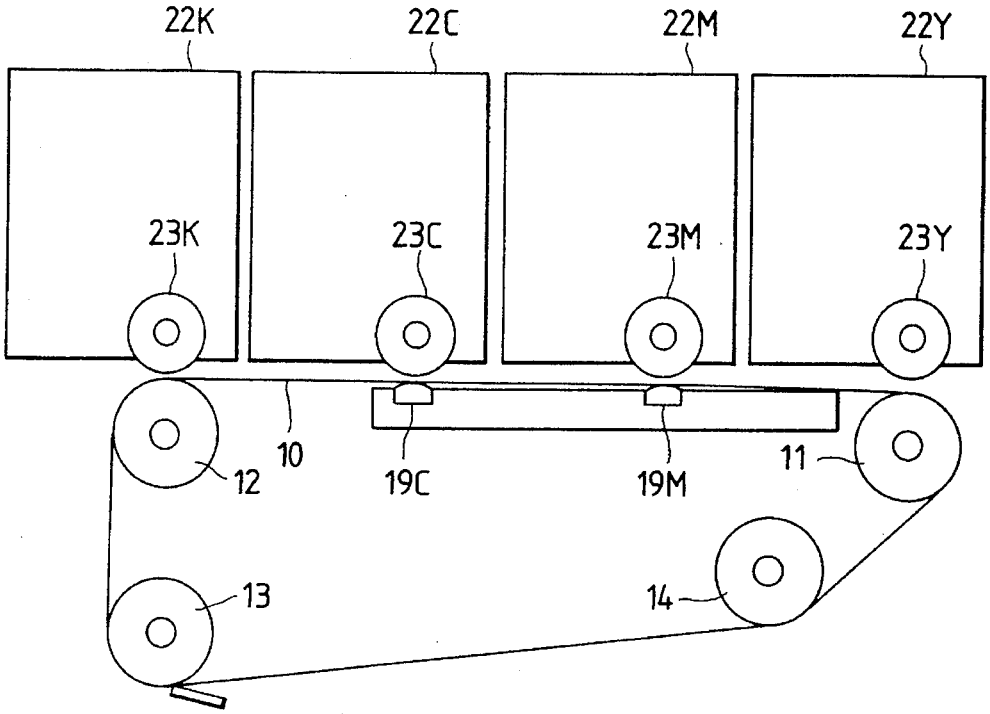
FIG. 8 is a side view illustrating the opposing relationship between the photosensitive belt and the developing rollers in the photosensitive belt unit according to the present invention.

FIG. 8 illustrates the opposing relationship between the photosensitive belt 10 and the developing rollers 23Y to 23K, wherein the developing roller 23Y is opposed to a region that rotates under the restriction by the outer peripheral surface of the drive roller 11, and the developing roller 23K is opposed to a region that rotates under the restriction by the outer peripheral surface of the driven roller 12. The developing rollers 23M and 23C are opposed to a region of the photosensitive belt 10 that rotates under the restriction by the upper surfaces of developing gap-setting members 19M and 19C that are provided in the photosensitive belt casing 70.

Figure 9:
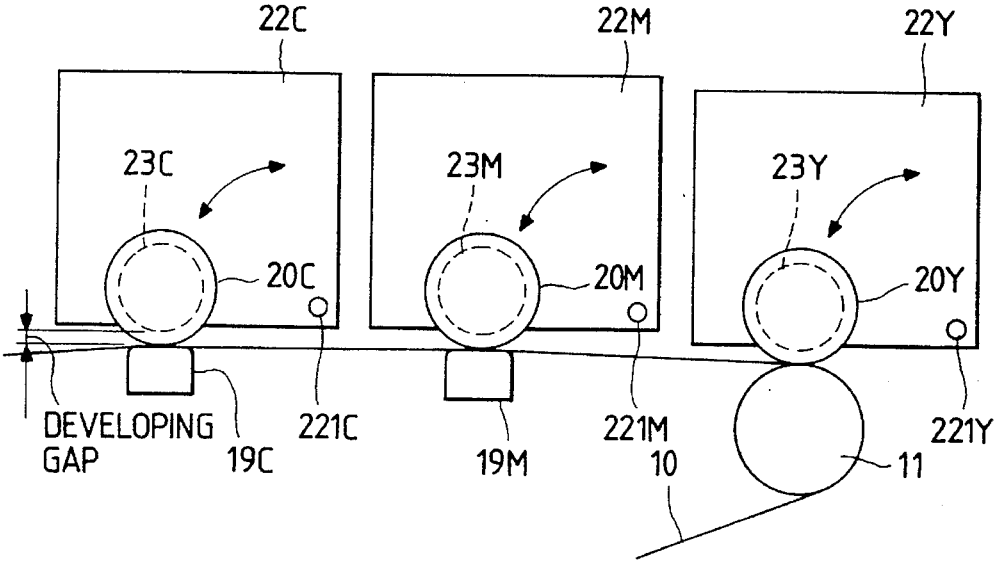
FIG. 9 is a side view of a developing gap-setting mechanism in the photosensitive belt unit according to the present invention.

FIG. 9 illustrates a mechanism that restricts the developing gaps between the photosensitive belt 10 and the developing rollers 23Y, 23M, 23C, - - - . The developing rollers 23Y, 23M, 23C, - - - have gap-setting rings 20Y, 20M, 20C, - - - that are coaxially provided at the ends of shafts thereof. The developing devices 22Y, 22M, 22C, - - - are rotatably supported at fulcrums 221Y, 221M, 221C, - - - , and a rotational force in the counterclockwise direction is applied to the developing devices 22Y, 22M, 22C, - - - . As the developing devices 22Y, 22M, 22C, - - - are rotated by the rotational force, the gap-setting ring 20Y comes into contact with the outer periphery of the drive roller 11 to define the developing gap between the photosensitive belt 10 and the developing roller 20, and the gap-setting rings 20M and 20C come into contact with the upper surfaces of the developing gap-setting members 19M and 19C to define the developing gaps between the photosensitive belt 10 and the developing rollers 23M, 23C.

The upper surfaces of the developing gap-setting members 19Y and 19C are higher than the outer peripheral surfaces of the drive roller 11 and the driven roller 12, whereby the photosensitive belt 10 is in reliable contact with the developing gap-setting members 19M and 19C to provide a stable developing region and to make it easy to maintain a precise developing gaps between the photosensitive belt 10 and the developing rollers 23Y, 23M, 23C and 23K. This constitution absorbs variation in the sizes of the constituent parts and helps decreasing the cost of production.

Figure 1:
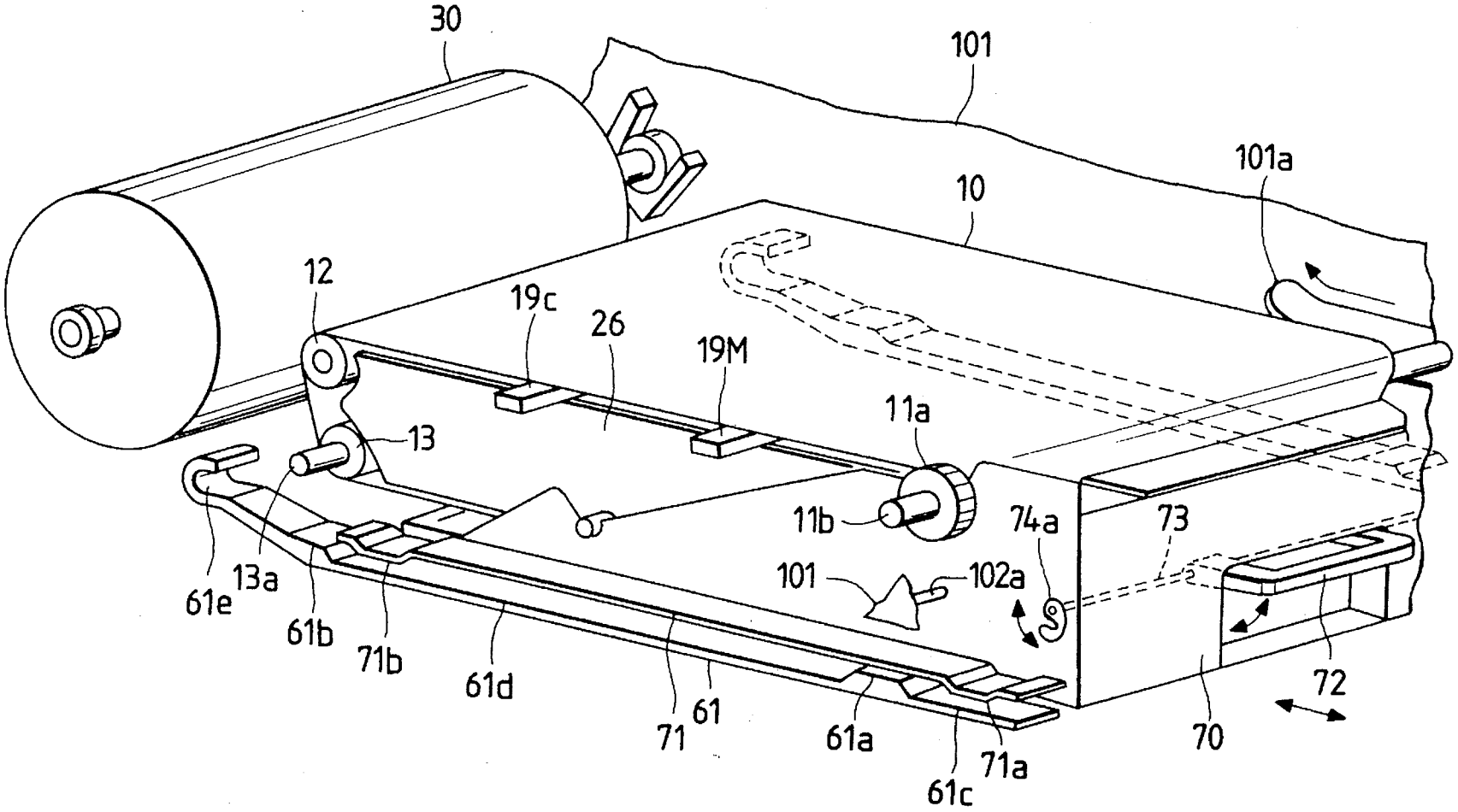
FIG. 1 is a perspective view of a mechanism for attaching or detaching a photosensitive belt unit of the present invention.

FIG. 1 illustrates a mechanism for attaching or detaching the photosensitive belt unit, by which the photosensitive belt 10 can be fitted in the photosensitive belt casing 70 in a correct position inside the frame 100. A slide member 71 is mounted on the side surface of the photosensitive belt casing 70 that holds the rollers 11 to 14 around which the photosensitive belt 10 is wrapped. The slide member 71 moves along a guide rail 61 which has protuberances 61*a* and 61*b*. When the slide member 71 having protuberances 71*a* and 71*b* is so moved that the protuberances 71*a* and 71*b* moves over the protuberances 61*a* and 61*b*, the photosensitive belt casing 70 is pushed up. That is, for the movement for the attachment and the detachment, the photosensitive belt casing 70 is so guided to slide along low portions 61*c* and 61*d* of the guide rail 61, so that the photosensitive belt 10 will not be damaged due to the contact with the developing devices 22Y, 22M, 22C and 22K. When the photosensitive belt 10 is in the positioning region, the protuberances 71*a* and 71*b* of the slide member 71 are riding on the protuberances 61*a* and 61*b* of the guide rail 51 to push up the photosensitive belt casing 70, so that the photosensitive belt 10 is kept at a predetermined height.

The engaging shaft 11*b* protruded coaxially with the drive roller 11 advances or retreats along an engaging groove 101*a* formed in the side plate 101 of the frame 100 at the time when the photosensitive belt casing 70 is being attached or detached, and is positioned at the inner end of the engaging groove 101*a* when the photosensitive belt casing 70 is attached. The engaging shaft 13*a* protruded coaxially with the driven roller 13 is positioned in engagement with a curved surface 61*e* that is formed at the inner end of the guide rail 61.

When the handle 72 is set in fall-down position after mounting the photosensitive belt casing 70, the hook 74*a* (74*b*) fixed to the both ends of the rotating shaft 73 engages with the engaging pin 102*a* (102*b*) perpendicularly mounted on the inside face of the side wall 101 to push the photosensitive belt casing 70 toward its mounting direction. By means of this function, the engaging shaft 11*b* is positioned both in the mounting direction and in the perpendicular direction against the mounting direction with touching to the inner end of the engaging groove 101*a*, and the engaging shaft 13*a* is positioned in the perpendicular direction against the mounting direction with the curved surface 61*e*. The curved surface 61*e* forms a margin of a slight gap in the mounting direction for the engaging shaft 13*a* in the condition where the photosensitive belt casing 70 is mounted.

As described above, the engaging shafts 11*b* and 13*a* coaxial with the rollers around which the photosensitive belt 10 is wrapped are brought into engagement with the guide rail 61 (curved surface 61*e*) and the frame 100 (side plate 101) to position the photosensitive belt 10. Therefore, the photosensitive belt 10 is precisely positioned with respect to the frame 100 making it possible to maintain accurate developing gaps between the photosensitive belt 10 and the developing rollers 23Y, 23M, 23C and 23K in the developing devices 22Y, 22M, 22C and 22K provided in the frame 100, to maintain good contact condition relative to the intermediate transfer drum 30, and to maintain accurately opposed relationship relative to the exposing device 25. Especially, with the engaging shaft 11*b* being positioned both in the mounting direction and in the perpendicular direction against the mounting direction with touching to the inner end of the engaging groove 101*a*, there is arising advantage in that the error in engaging can be decreased when the toothed wheel 11*a* is engaged with the driving mechanism in the fixed side to form the power transmission system.

According to the present invention, the engaging shafts protruding coaxially with the rollers that support the photosensitive belt in the photosensitive belt unit are positioned in engagement with the positioning members of the frame and are installed in the apparatus, permitting the photosensitive belt to oppose the developing devices and the intermediate transfer drum with a high precision.

What is claimed is:

1. An image forming apparatus comprising a photosensitive belt unit including an endless photosensitive belt that is wrapped around a plurality of rollers supported by a casing, a drive means which rotates said rollers to move said photosensitive belt, a toner image forming means which forms a toner image on the surface of said photosensitive belt that is running, an intermediate transfer drum which rotates in contact with the surface of said photosensitive belt and on which said toner image formed on the surface of said photosensitive belt is transferred, and a frame for assembling them, wherein:

said photosensitive belt unit has a first roller and a second roller that support said photosensitive belt in such a manner as to form a region in contact with said intermediate transfer drum with a predetermined contact width, a third roller which supports said photosensitive belt in such a manner as to form a region where the toner image is formed, and an engaging shaft which is protruded coaxially with said first or second roller; and said frame has a positioning member by which said photosensitive belt unit is detachably received and which receives the engaging shaft when the photosensitive belt is mounted so as to position the photosensitive belt unit.

2. An image forming apparatus according to claim 1, wherein either of said first roller and said second roller is a tension roller, and said engaging shaft is provided coaxially with the other fixed roller.

3. An image forming apparatus according to claim 1, wherein said positioning member is formed integrally with a guide rail that is used for mounting/dismounting said photosensitive belt unit.

4. An image forming apparatus comprising a photosensitive belt unit including an endless photosensitive belt that is wrapped around a plurality of rollers supported by a casing, a drive means which rotates said rollers to move said photosensitive belt, a toner image forming means which forms a toner image on the surface of said photosensitive belt that is running, an intermediate transfer drum which rotates in contact with the surface of said photosensitive belt and on which said toner image formed on the surface of said photosensitive belt is transferred, and a frame for assembling them, wherein:

said photosensitive belt unit has a first roller and a second roller that support said photosensitive belt in such a manner as to form a region in contact with said intermediate transfer drum with a predetermined contact width, a third roller which supports said photosensitive belt in such a manner as to form a region where the toner image is formed, a first engaging shaft which is protruded coaxially with said first or second roller, and a second engaging shaft which is protruded coaxially with said third roller; and said frame has a first and a second positioning members by which said photosensitive belt unit is detachably received and at least said first positioning member receives the first engaging shaft when the photosensitive belt is mounted so as to position the photosensitive belt unit.

5. An image forming apparatus according to claim 4, wherein said first positioning member receives and supports said first engaging shaft in such a manner as to position in the perpendicular direction against the mounting direction of the photosensitive belt unit, said second positioning member receives and supports said second engaging shaft in such a manner as to position both in the mounting direction of the photosensitive belt unit and in the perpendicular direction against the mounting direction of the photosensitive belt unit.

6. An image forming apparatus according to claim 4, wherein said first positioning member receives and supports said first engaging shaft in such a manner as to position in the perpendicular direction against the mounting direction of the photosensitive belt unit and to be slidable in the mounting direction, said second positioning member receives and supports said second engaging shaft in such a manner as to position both in the mounting direction of the photosensitive belt unit and in the perpendicular direction against the mounting direction of the photosensitive belt unit.

7. An image forming apparatus according to claim 4, wherein said photosensitive belt unit comprising a hook serving in such a manner as to push said photosensitive belt unit toward the mounting direction with engaging with an engaging pin attached to the frame body.

* * * * *